United States Patent [19]

Laemmermann et al.

[11] Patent Number: 4,497,120

[45] Date of Patent: Feb. 5, 1985

[54] PROCEDURE AND APPARATUS FOR CHARGING AND EMPTYING THE DRYING TRAYS IN A DRYING BOX

[75] Inventors: Fritz Laemmermann, Frankenthal; Werner Rindfleisch, Mannheim; Wolfgang Fabian, Wilhelmsfeld; Rudolf Polster, Frankenthal, all of Fed. Rep. of Germany

[73] Assignee: BASF Aktiengesellschaft, Ludwigshafen, Fed. Rep. of Germany

[21] Appl. No.: 489,213

[22] Filed: Apr. 27, 1983

[30] Foreign Application Priority Data

Apr. 28, 1982 [DE] Fed. Rep. of Germany ..... 3215753

[51] Int. Cl.[3] ..... F26B 5/04

[52] U.S. Cl. ..... 34/15; 34/57 R; 34/92; 34/236; 34/237; 406/122; 406/171

[58] Field of Search ..... 34/15, 57 R, 92, 236, 34/237; 406/122, 171

[56] References Cited

U.S. PATENT DOCUMENTS

| | | | |
|---|---|---|---|
| 2,509,681 | 5/1950 | Flosdorf | 34/15 |
| 2,676,417 | 4/1954 | Ekelund | 34/92 |
| 2,710,456 | 6/1955 | Andersen | 34/92 |
| 3,460,269 | 8/1969 | Kessler | 34/92 |
| 4,035,924 | 7/1977 | Faure | 34/92 |
| 4,177,574 | 12/1979 | Kobayashi et al. | 34/15 |
| 4,353,222 | 10/1982 | Kobayashi | 62/275 |
| 4,426,793 | 1/1984 | Kuboyama | 34/15 |

FOREIGN PATENT DOCUMENTS

| | | | |
|---|---|---|---|
| 1145432 | 3/1969 | United Kingdom | 406/171 |

*Primary Examiner*—Larry I. Schwartz
*Assistant Examiner*—David W. Westphal
*Attorney, Agent, or Firm*—Keil & Weinkauf

[57] ABSTRACT

A procedure and apparatus for charging and emptying the drying trays in a drying box containing pumpable, solvent-moist starting materials and end products which can be conveyed pneumatically, in which procedure, for filling, the drying trays are closed by means of cover plates and the solvent-moist starting materials are pumped into the filling spaces which are thus formed, these spaces being opened on commencing the drying process, and being closed again following completion of this process, after which the end products are conveyed away from the filling spaces by pneumatic means.

This procedure enables drying boxes to be employed for drying even pumpable, solvent-moist products, the recommendations relating, respectively, to explosion protection and to maximum permissible concentrations of toxic materials at workplaces, being complied with, while the operations of charging and emptying the drying boxes are, at the same time, carried out by mechanical means, and hence at lower cost.

10 Claims, 4 Drawing Figures

Figure 1:
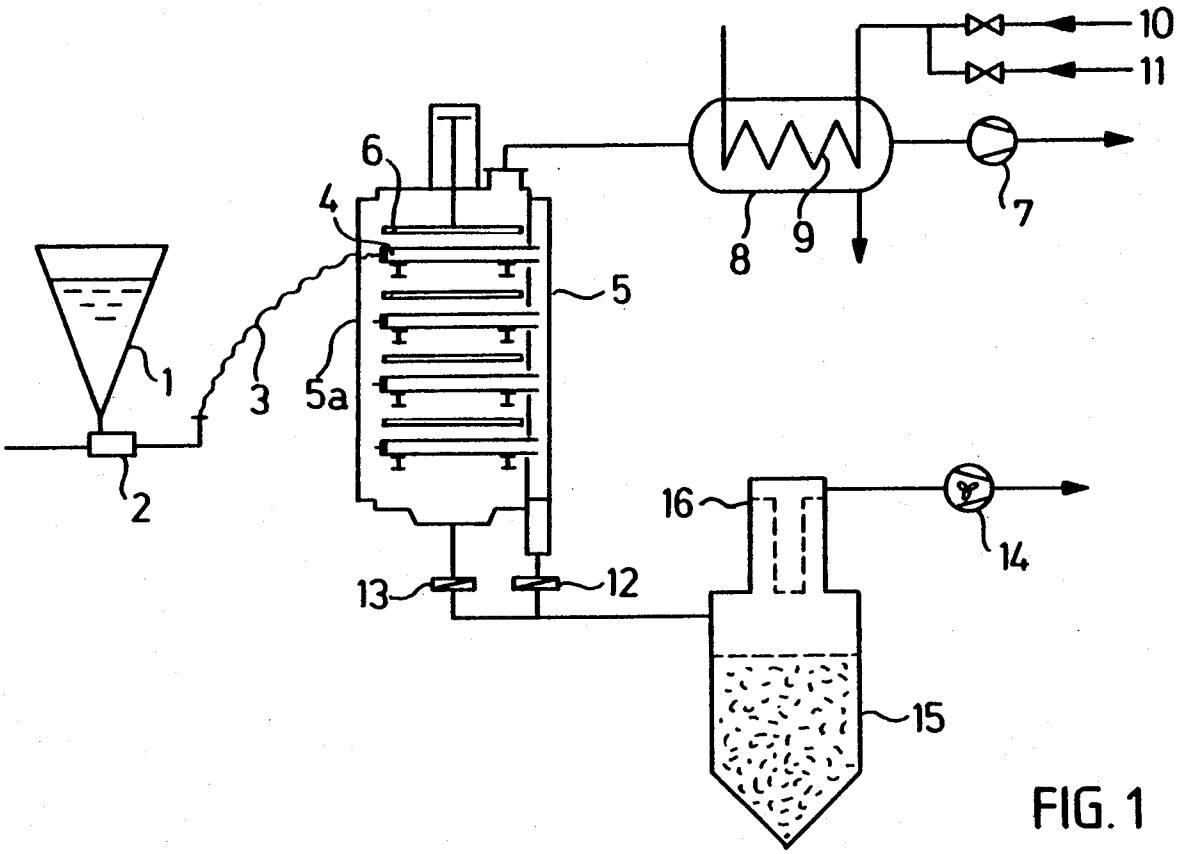

PROCEDURE AND APPARATUS FOR CHARGING AND EMPTYING THE DRYING TRAYS IN A DRYING BOX

The invention relates to a procedure for charging and emptying the drying trays in a drying box containing pumpable, solvent-moist starting materials, and end products which can be conveyed pneumatically, the drying process being effected by heating the starting material by means of radiation, convection or by contact, as well as to apparatus for carrying out the procedure.

The operation of filling the drying trays in a commercially available vacuum drying box with pumpable, solvent-moist starting materials, while at the same time complying with the recommendations relating, respectively, to explosion protection and to maximum permissible concentrations of toxic materials at workplaces, can be carried out only by means of a highly complicated procedure, performed, for example, in a separate room with adequate ventilation while, in addition, breathing equipment is worn. The operation of emptying the drying trays is, as a rule, carried out by tipping the individual drying trays, or the complete stack of trays, in a tipping appliance, a procedure which, in the case of various products, is attended by a dust nuisance. Furthermore, the operations of filling and emptying the drying trays represent two complicated process steps which are, therefore, labor-intensive.

The object of the present invention is accordingly to develop a simple procedure for charging and emptying drying trays containing pumpable, solvent-moist starting materials, and end products which can be conveyed pneumatically, while complying with the recommendations relating, respectively, to explosion protection and to maximum permissible concentrations of toxic materials at workplaces and, at the same time, reducing the cost of these operations.

We have found that this object is achieved by means of a procedure wherein, for filling, the drying trays are closed by means of cover plates and the solvent-moist starting materials are pumped into the filling spaces which are thus formed, these spaces being opened on commencing the drying process, and being closed again following completion of this process after which the end products are conveyed away from the filling spaces by pneumatic means. Further features of the apparatus according to the invention for carrying out the procedure are covered by the sub-claims.

An embodiment of the invention is illustrated in the drawing, and is described in more detail in the text which follows.

Figure 2:
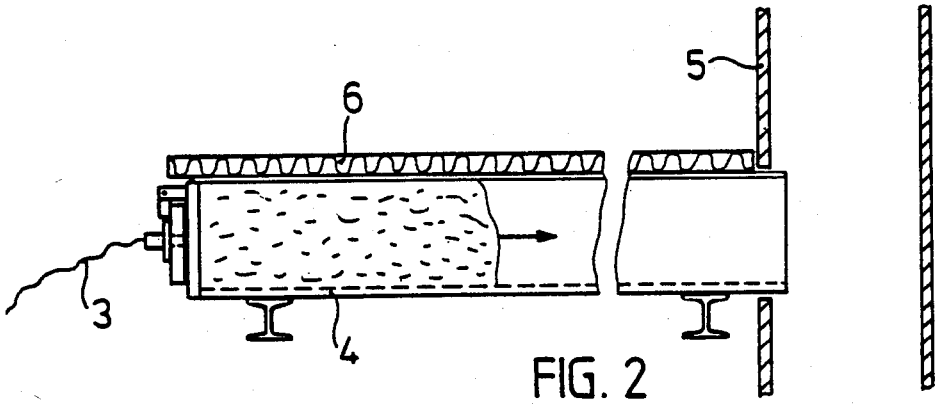
Figure 3:
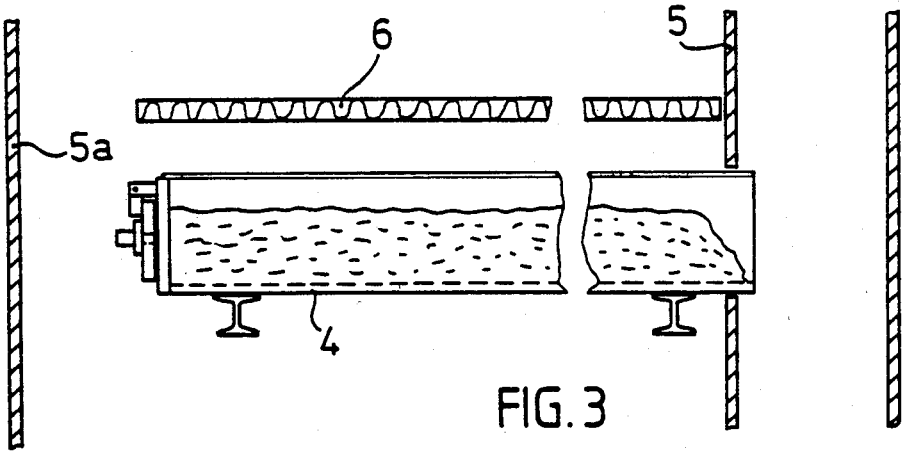
Figure 4:
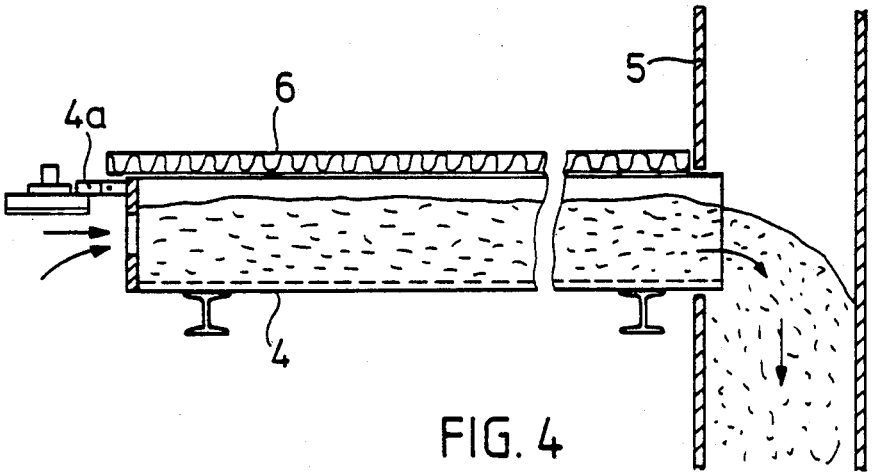

In the drawing:

FIG. 1 shows a process flow diagram for a vacuum drying process in a vacuum drying box, FIG. 2 shows a partial cross-section through the vacuum drying box and a drying tray, during the filling operation, FIG. 3 shows a partial cross-section through the vacuum drying box and a drying tray, during the drying process and FIG. 4 shows a partial cross-section through the vacuum drying box and a drying tray, during the emptying operation.

As shown in FIG. 1, the pump 2 conveys a paste from the stock vessel 1, into the drying trays 4 of the vacuum drying box 5, via a flexible connection 3. As illustrated in FIG. 2, the filling spaces are formed, prior to the filling operation, by lowering the heating plates 6, or by raising the drying trays 4. By suitably specifying both the length of the stroke of the piston in the pump 2, and the number of strokes, it is possible to pump, into the drying tray 4, that volume of paste which corresponds to the filling space within one drying tray, thereby ensuring that all the drying trays 4 are filled uniformly. After having filled all the drying trays 4, and after having closed the vacuum drying box 5, the latter is evacuated by means of a vacuum station 7. While the box is being evacuated, the heating plates 6 are raised, as represented in FIG. 3, or the drying trays 4 are lowered. The heat which is required in order to evaporate the solvent is supplied by the heating plates 6. The solvent vapors are condensed or desublimed on the tubes 9 of the heat exchanger 8, cooling water 10 or, depending on the type of drying, brine 11 at a low temperature, flowing through the tubes. After completion of the drying process, the filling spaces are again closed, by lowering the heating plates 6, or by raising the drying trays 4, and air is admitted to the vacuum drying box 5, to restore the pressure inside it to the atmospheric pressure. The process just described brings about the conversion of the material in the drying trays 4, which had originally been in the form of a paste, into an end product which can be conveyed by pneumatic means. After having re-introduced the atmospheric pressure, and after opening the door 5*a*, the filling end front face 4*a* of each tray is opened, as shown in FIG. 4, and the valve 12 is opened and the end product is drawn off by means of a fan 14, and collected in the end-product vessel 15. The fine dust which is entrained with the end product is deposited in a filter 16, installed between the valve 12 and the vessel 15. In order to ensure that the drying trays 4 are emptied completely, the front faces 4*a* of the drying trays 4 are hinged upward, as illustrated in FIG. 4, thereby exposing a ventilation slot extending across the width of each drying tray 4. During the operation, carried out pneumatically, of emptying the drying trays 4, the condensate or sublimate in the heat exchanger 8 can be pumped off or, in the case of a sublimate, thawed off and then pumped off. The dust fraction produced during the drying process collects on the bottom of the vacuum drying box 5, and can be drawn off, by suction, after opening the valve 13.

The advantages which are obtained by means of the procedure according to the invention, and by employing the arrangement according to the invention for carrying out this procedure, reside particularly in the fact that drying boxes can be employed for drying even pumpable, solvent-moist products, the recommendations relating, respectively, to explosion protection and to maximum permissible concentrations of toxic materials at workplaces being complied with, while the operations of charging and emptying the drying boxes are, at the same time, carried out by mechanical means, and hence at lower cost. Although, if water is used as the solvent, the operation of filling the drying trays clearly involves no hazards of a safety engineering or health-related nature, the novel procedure nevertheless eliminates the dust nuisance during the operation of emptying the drying trays.

We claim:

1. An improved process for loading and unloading a drying tray within a drying box wherein a material may be dried by heating and which drying tray is provided with a cover that may be raised and lowered relative to said tray to open and close said tray, said process comprising:

closing said tray;

pumping a pumpable solvent-moist starting material into the closed tray to fill said tray;

opening the filled tray and drying the material therein;

closing the tray upon the material being dried; and drawing air through the closed tray whereby to pneumatically convey the dried material from said tray.

2. The process of claim 1, wherein the said starting material is pumped into said closed tray from a filling end thereof.

3. The process of claim 2, wherein the filling end of said tray is opened upon the material in said tray having been dried and air is drawn through said filling end and out an end of said tray opposite said filling end.

4. The process of claim 1, wherein the said drying box is closed at least during the period of opening the filled tray and drying the material therein, and during said period said box is evacuated to remove solvent vapors from said tray and box.

5. An improved apparatus for drying solvent-moist starting material and for loading and unloading said material thereto, said apparatus comprising:

a drying box;

at least one drying tray within said drying box;

a cover plate for each said drying tray, said cover plate and drying tray being relatively movable between open and closed positions;

a stock vessel for storing pumpable solvent-moist starting material to be dried in said drying tray;

a flexible supply line and pump connected between said stock vessel and one end of said drying tray for conveying starting material thereto;

vacuum means connected to said drying box;

a heat exchanger located between said vacuum means and said drying box for condensing vapors evacuated from said drying box;

removal means in communication with said drying tray to draw air therefrom to a point outside of said drying box; and a product vessel located outside said drying box connected between said removal means and said drying tray.

6. The apparatus of claim 5, wherein the product vessel includes a filter.

7. The apparatus of claim 5, wherein the said one end of said drying tray is pivotable to open a ventilation slot and allow air to enter said tray.

8. The apparatus of claim 7, wherein said removal means is connected to an end of said drying tray opposite said one end.

9. The apparatus of claim 5, wherein said removal means is connected to an end of said drying tray opposite said one end.

10. The apparatus of claim 5, wherein the said cover plate provides heat to material in said drying tray.

* * * * *